US006637848B2

(12) United States Patent
Lin

(10) Patent No.: US 6,637,848 B2
(45) Date of Patent: Oct. 28, 2003

(54) FULLY PULLED-OUT TYPE MOBILE APPARATUS

(76) Inventor: Chin-Chih Lin, 3F, No. 128, Cha-Zhuang 1st Street, Kuei Shan, Taoyuan Hsien (TW)

( * ) Notice: Subject to any disclaimer, the term of this patent is extended or adjusted under 35 U.S.C. 154(b) by 0 days.

(21) Appl. No.: 10/115,938

(22) Filed: Apr. 5, 2002

(65) Prior Publication Data

US 2003/0168953 A1 Sep. 11, 2003

(30) Foreign Application Priority Data

Mar. 7, 2002 (TW) ..... 09120651 A

(51) Int. Cl.[7] ..... A47B 88/00
(52) U.S. Cl. ..... 312/334.23; 312/334.26
(58) Field of Search ..... 312/334.23, 334.26, 312/334.2, 330.1, 334.1, 334.7, 334.8, 348.1, 404

(56) References Cited

U.S. PATENT DOCUMENTS 2,801,146 A * 7/1957 Mikulas ..... 312/301
3,929,386 A * 12/1975 Read ..... 384/22
4,537,450 A * 8/1985 Baxter ..... 384/18
5,090,787 A * 2/1992 Harley ..... 312/334.7
5,873,458 A * 2/1999 Kao ..... 206/308.1
6,056,378 A * 5/2000 Semon et al. ..... 312/246
6,209,979 B1 * 4/2001 Fall et al. ..... 312/330.1
6,416,145 B1 * 7/2002 Singh ..... 312/334.1
2002/0005687 A1 * 1/2002 Corona ..... 312/334.33
2002/0180320 A1 * 12/2002 Amsterdam ..... 312/291
2003/0006682 A1 * 1/2003 Hoffman ..... 312/334.1

* cited by examiner

*Primary Examiner*—Leslie A. Braun
*Assistant Examiner*—Kofi Schulterbrandt
(74) *Attorney, Agent, or Firm*—Troxell Law Office PLLC

(57) ABSTRACT

A fully pulled-out type mobile apparatus comprises an extractable device, two relay levers and two guide rails. The extractable device provides two opposite lateral sides with a respective proper slot at a bottom thereof being between at least two opposite guideposts extending downward from the bottom. Each of the relay levers provides an elongated groove for being passed through by the guideposts with a connecting piece engaging with at least one of the guideposts such that the guideposts can be received and displace in the elongated groove. Each of the guide rails provides an outer rail part, an inner rail part and a ball structure between the outer and the inner rail parts. The ball structure has a length at least equaling to a length between two guideposts at both ends of the extractable device and the inner rails of the guide rails connecting with the relay levers respectively so as to move with each other. In case of the extractable device being pulled out, the guideposts moves outward along the elongated grooves till a respective outermost one of the guideposts touching outer ends of the elongated grooves as soon as the inner and outer rails oppositely sandwiching the respective ball structure such that the extractable device can be pulled out completely.

5 Claims, 5 Drawing Sheets

FULLY PULLED-OUT TYPE MOBILE APPARATUS

BACKGROUND OF THE INVENTION

1. Field of The Invention

The present invention relates to a fully pulled-out type mobile apparatus, and particularly, to an extractable device with two lateral sides thereof in conjunction with a relay lever respectively and the relay lever connecting with a guide rail so that guideposts at the lateral sides of the extractable device can move along a locating groove in the respective relay lever to constitute the full pulled-out type mobile apparatus.

2. Description of Related Art

There is a great chance for us to use an extractable device such as a drawer to take out articles therein. In order to be pulled out smoothly, usually a guide rail is mounted between the extractable device at respective lateral side thereof and the fixing device such as a cabinet. The guide rail provides an outer rail part fixedly attached to the fixing device and an inner rail being fixedly attached to the extractable device such that a ball structure disposed between the outer and the inner rails can offer the smoothness while the outer rails are pulled outward or pushed inward relative to the inner rails.

Because the ball structure between the outer and the inner rails is a required part in the respective guide, a partial length of the ball structure is enclosed with the front end of the outer rail and the rear end of the inner rail as the extractable device is pulled out to a limit position. In this way, the interior space of the extractable device is blocked by the front edge of the fixing device such that it results in a considerable part of the volume of the extractable device becomes less unconsciously in addition to the articles being inconvenient during articles being placed into or taken out. If the conventional guide rails are applied in an extractable device for taking in plate like articles such as diskettes or compact disks, it is the deficiency that the conventional guide rails causes the plate like articles being hard to be taken out from or inserted into the interior of extractable device.

SUMMARY OF THE INVENTION

The crux of present invention is to provide a fully pulled-out type mobile apparatus, which comprises extractable device, two relay levers and two guide rails. The extractable device provide two opposite lateral sides with a respective proper spot at a bottom thereof being between at least two opposite guideposts extending downward from the bottom. Each of the relay levers provides an elongated groove for being passed through by the guideposts with a connecting piece engaging with at least one of the guideposts such that the guideposts can be received and displace in the elongated groove. Each of the guide rails provides an outer rail part, an inner rail part and a ball structure between the outer and the inner rail parts. The ball structure has a length at least equaling to a length between two guideposts at both ends of the extractable device and the inner rails of the guide rails connecting with the relay levers respectively so as to move with each other. In case of the extractable device being pulled out, the guideposts moves outward along the elongated grooves till a respective outermost one of the guideposts touching outer ends of the elongated grooves as soon as the inner and outer rails oppositely sandwiching the respective ball structure such that the extractable device can be pulled out completely.

BRIEF DESCRIPTION OF THE DRAWINGS

The present invention can be more fully understood by reference to the following detailed description and accompanying drawings, in which.

DETAILED DESCRIPTION OF THE PREFERRED EMBODIMENTS

Figure 1:
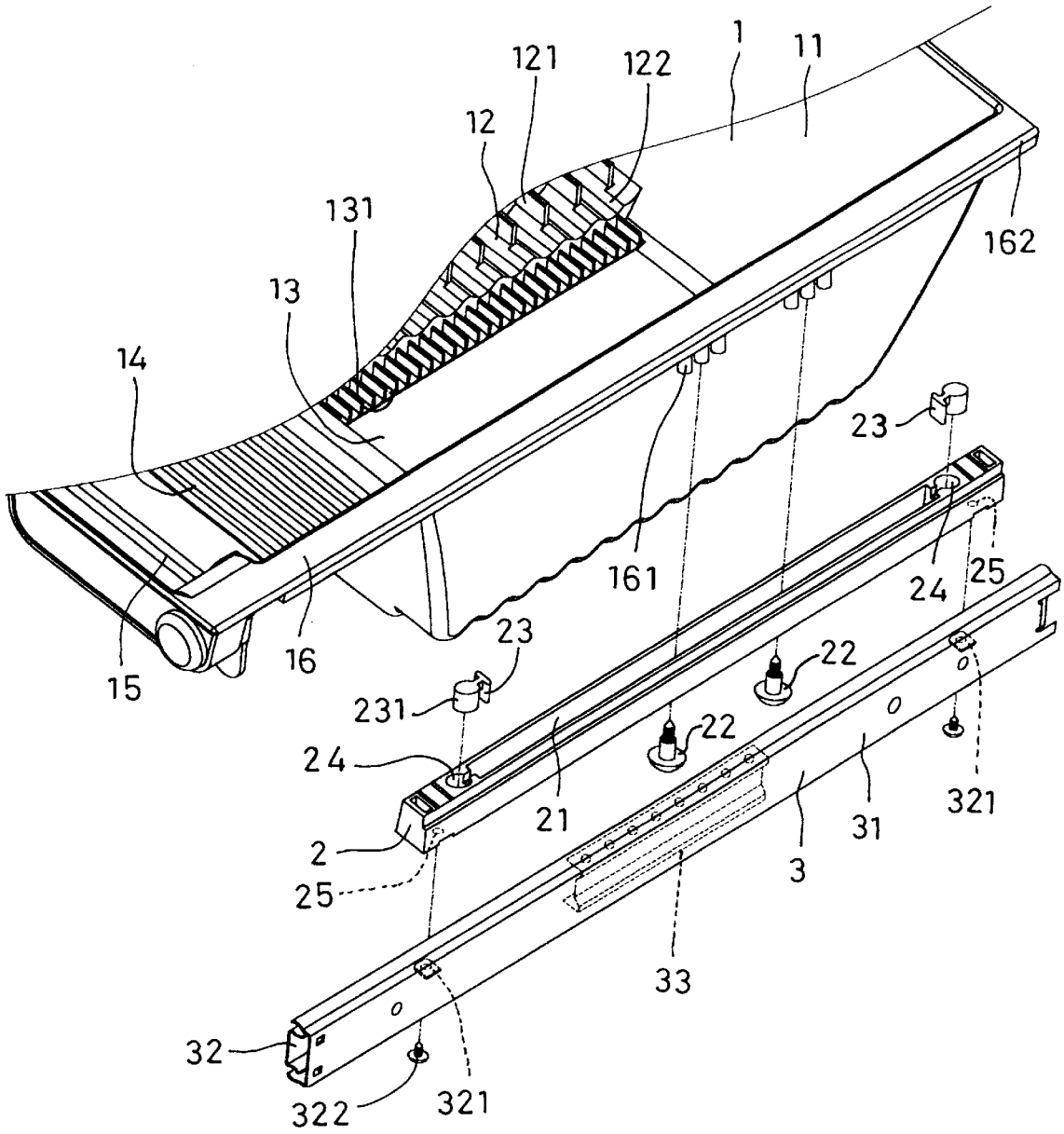
FIG. 1 is a partly exploded perspective view of a fully pulled-out type mobile apparatus according to the present invention.
Figure 2:
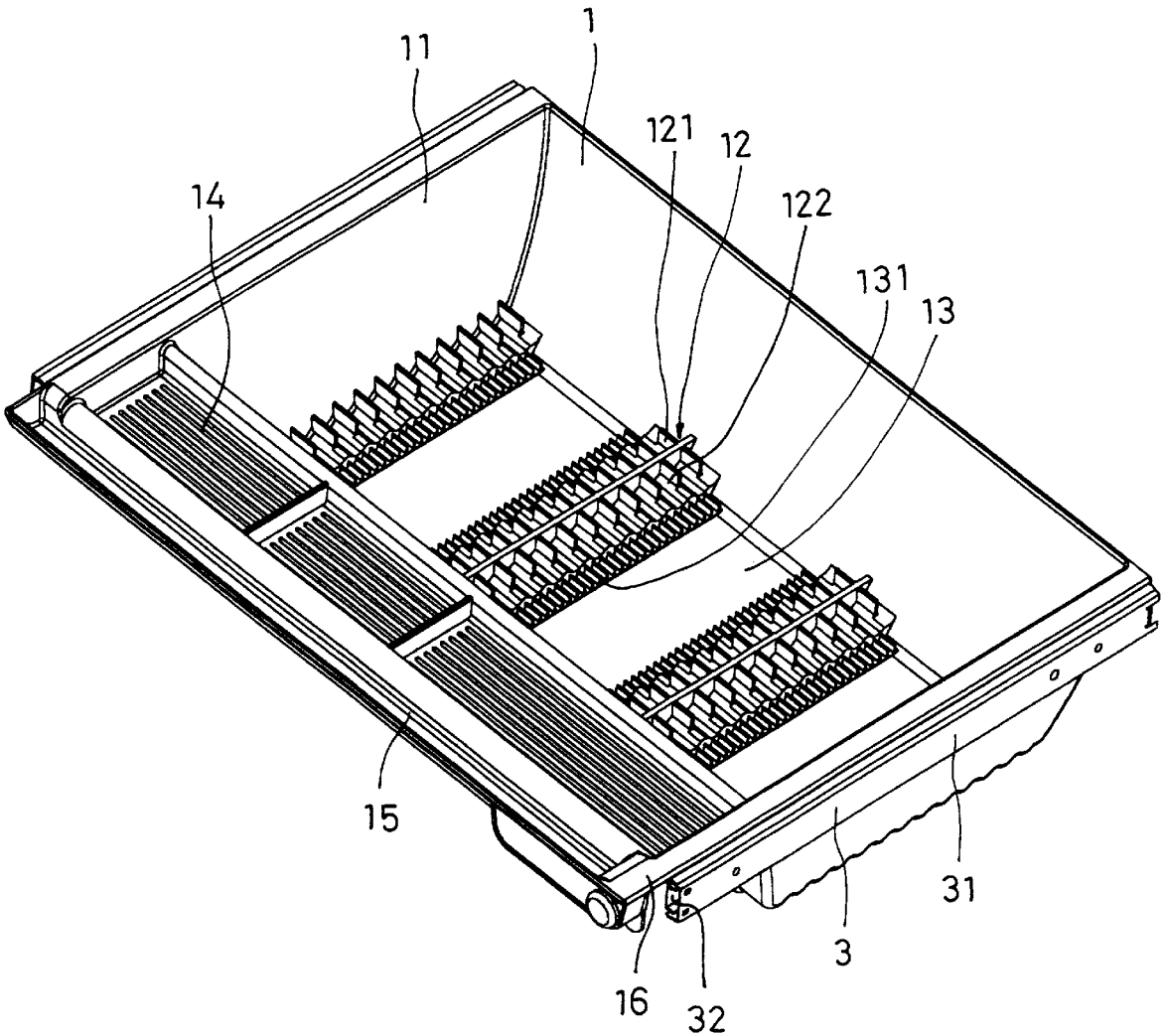
FIG. 2 is a perspective top view of the fully pulled-out mobile apparatus of the present invention.
Figure 3:
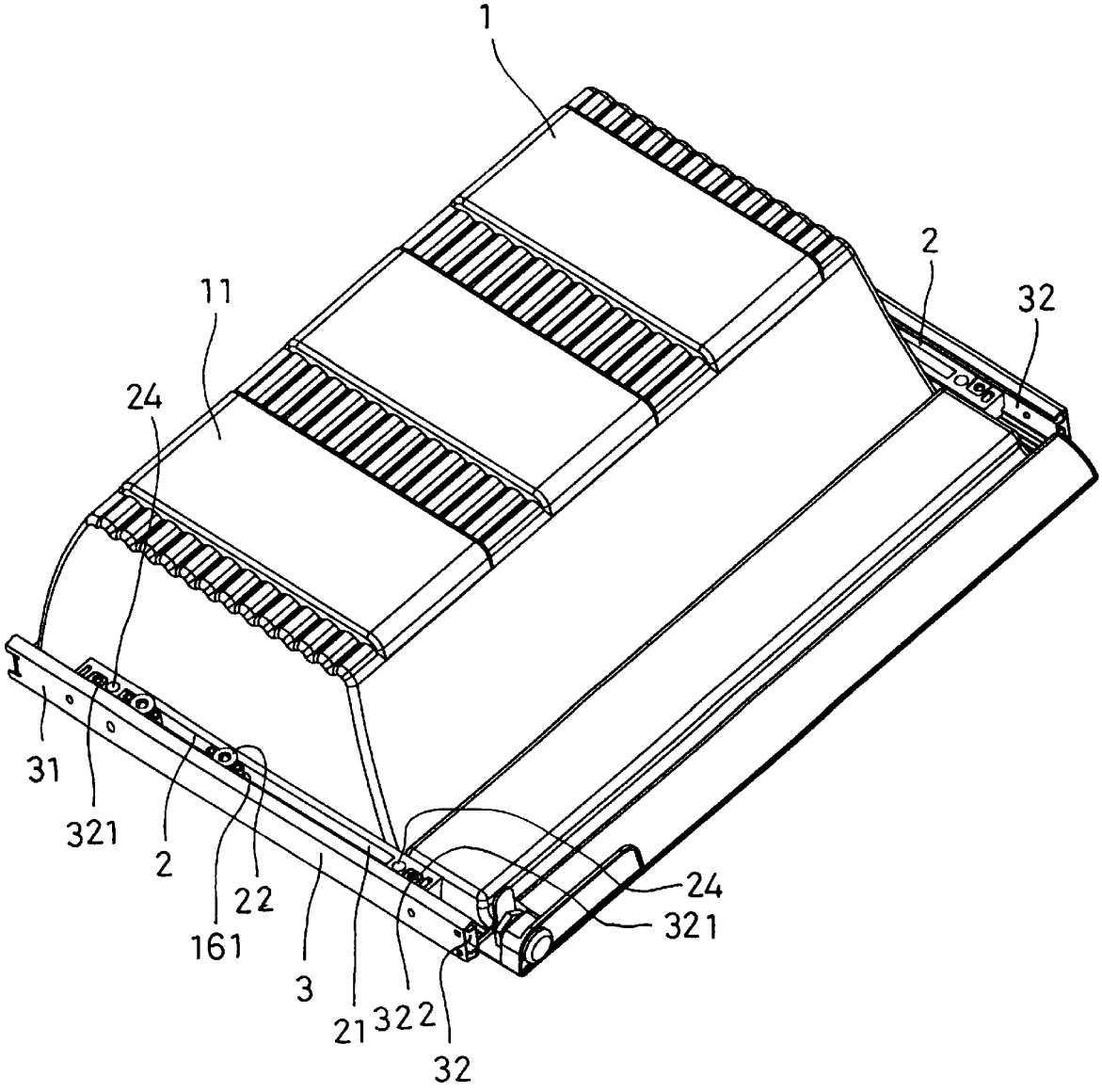
FIG. 3 is a perspective bottom view of the fully pulled-out mobile apparatus of the present invention.
Figure 4:
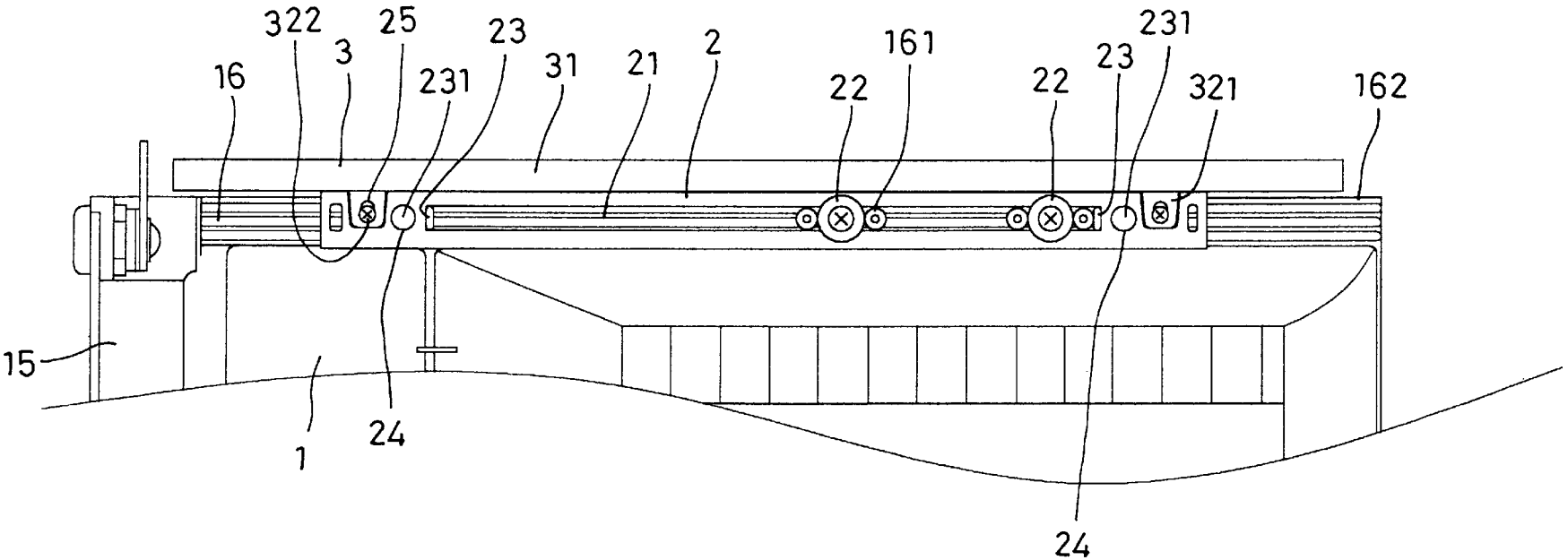
FIG. 4 is a fragmentary bottom view of the assembled mobile apparatus of the present invention.

Referring to FIGS. 1 to 5, basically, a full-pull type mobile apparatus of the present invention comprises an extractable device 1, two relay levers 2 and two guide rails.

The extractable device 1 has a box body 11 with an open top and can be placed with articles on the inner bottom thereof. If the articles such as compact disks or diskettes, are placed in order on the inner bottom, a plurality of spaced projection sections 12 are arranged longitudinally in the extractable device 1 and a plurality of projection pieces 121 are provided to extend transversely and oppositely. Thus, a respective locating groove 122 is formed between any two of the projection pieces 121 for being inserted with a compact disk case. In addition, each of the spaced projection sections has a lateral recess 13 with a plurality of plate slots 131 facing to each other for being inserted with diskettes. Besides, a partitioned slot part 14 extends forward horizontally from the front side of the box body 11 with a handle part 15 being disposed in front of the slot part 14 so that the slot part 14 can be placed with the stationery and the handle part 15 can be held by a hand. The extractable device 1 is different from the conventional one in that two opposite lateral sides are provided with an abrupt edge 16 respectively and the bottom of the abrupt edge 16 at a proper spot thereof provides at least a left and a right guideposts 161 respectively for passing through and engaging with each of the relay levers 2. Further, the abrupt edge 16 at a lateral end thereof has a perpendicular rib 162 to define a channel with the outer wall of the box body 11 for receiving the respective relay lever 2 so that the relay levers 2 can displace along the respective channel.

Each of the relay levers 2 is longitudinal and provides an elongated groove 21 for being movably inserted with the guideposts 161 undeviatingly by way of a fastener 22 such as a screw, selectively being fastened to the guideposts 161 so that the relay lever 2 can move with the guideposts 161 synchronously. In order to be capable of offering an effect of buffer during the guide levers 161 colliding both ends of the elongated groove 21, a cushion piece 23 is attached to both ends of the elongated groove 21 respectively with a post part 231, which is connected to the cushion piece 23, being inserted into a cylindrical hole 24 arranged at both ends of the elongated groove 21 respectively. Hence, in case of the guideposts 161 touching the ends of the elongated groove 21, the impact sound can be eliminated effectively in addition to the damage resulting from excessive impact being avoided. Besides, a connecting hole 25 is provided at both ends of the relay lever 2 respectively such that each of the relay levers 2 can be joined to one of the guide rails 3.

Each of the guide rails 3 is conventional, and is composed of an outer rail 31, an inner rail 32 and a ball structure 33 in between. Wherein the inner rail 32 has two projection lugs 321 to be disposed in a way of each of the projecting lugs corresponding to the respective connecting hole 25 such that the inner rail 32 in each guide rail 3 can be fastened to the respective relay lever 2 by way of fasteners such as screws passing through the projecting lugs 321. The ball structure 33 has a length at least equaling a distance between the guideposts 161 on each side of the extractable device 1.

Figure 5:
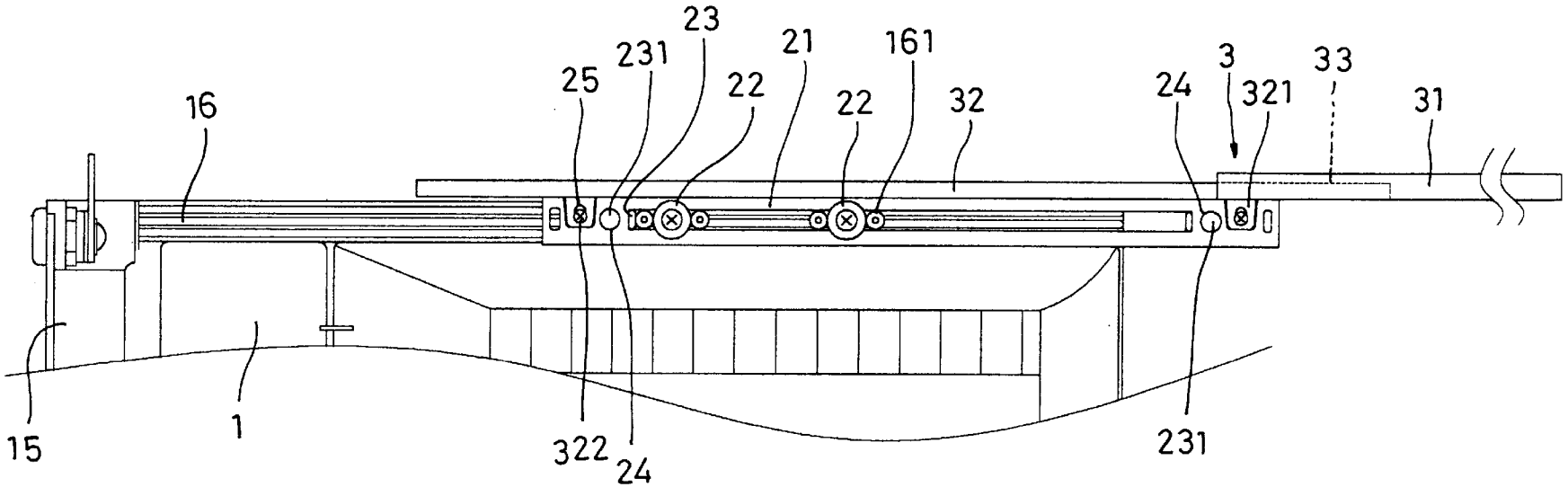
FIG. 5 is a fragmentary bottom view similar to FIG. 4 illustrating the mobile apparatus being in a state of being fully pulled out.

Referring to FIGS. 2 to 5 again, the outer rail 31 on the respective guide rail 3 at both lateral sides of the extractable device 1 is fixed to a stationary device such as a cabinet with two opposite inner walls. As soon as the user pulls the handle part 15 outward, the inner rails 32 with the relay levers 2 move outward at the same time first. Once the outer rails 31 and the inner rails 32 at the respective stoppers thereof touch the ball structure 33, it means that the inner rails 32 are unable to move outward further. At this time, the guideposts 161 displace outward along the elongated groove 21 till the guidepost 161 at the outer side touching the cushion 23 at the outer end of the elongated groove 21 as shown in FIG. 5. Thus, the extractable device 1 just can compensate the length of the ball structure 33 by way of the extra stroke of the guidepost 161 in the elongated groove 21 so that the box body 11 can be pulled out completely and it is not necessary to worry about whether it is blocked or not during the articles being taken out or inserted into.

On the other hand, in order to be closed, the extractable device 1 is pushed inversely till the stopper at the rear end of the outer rail 31 touching the rear end of the inner rail 32 and the guideposts 161 move toward the inner end of the elongated groove 21 till the guidepost 161 at the inner side touching the cushion 23 at the inner end of the elongated groove 21.

It is appreciated that the mobile apparatus according to the present invention has involved in relay levers being disposed between and connected to an extractable device and two guide rails respectively so that an extra stroke can be performed for the extractable device to compensate the length of a ball structure in the rails. Hence, the extractable device can be fully pulled out very conveniently to overcome the long time problem of the extractable device being not possible to be opened fully.

While the invention has been described with reference to a preferred embodiment thereof, it is to be understood that modifications or variations may be easily made without departing from the spirit of this invention, which is defined by the appended claims.

What is claimed is:

1. A fully pull-out type mobile apparatus, comprising:

an extractable device having two opposing lateral sides, each lateral side having an abrupt edge, each abrupt edge having at least two guideposts extending downward from, a bottom thereof;

two relay levers, each of the relay levers having an elongated groove, each of the at least two guideposts on each lateral side being slidably connected within the elongated groove of one of the two relay levers, each elongated groove having a cylindrical hole at opposing ends thereof;

a plurality of cushions, each cushion having a post, one post being inserted into each of the cylindrical holes of each elongated groove;

two guide rails, each of the guide rails providing an outer rail part, an inner rail part and a ball structure between the outer and the inner rail parts, the ball structure having a length at least as one as a distance between the at least two guideposts located on each side of the extractable device, and the inner rails of the guide rails connecting with the relay levers respectively so as to move with each other;

such that when the extractable device is being pulled out, the guideposts move along the elongated grooves until a respective outermost one of the guideposts contacts outer ends of the elongated grooves and the inner rails and relay lever move along the outer rails, the inner and outer rails oppositely sandwiching the respective ball structure to enable the extractable device to be pulled out completely.

2. The fully pulled-out type mobile apparatus according to claim 1, wherein the extractable device has a box body with a plurality of spaced projection sections being arranged longitudinally therein and a plurality of projection pieces being provided to extend transversely and oppositely such that a respective locating groove is formed between any two of the projection pieces for being inserted with a plate shaped article.

3. The fully pulled-out type mobile apparatus according to claim 2, wherein each of the spaced projection sections has a lateral recess with a plurality of plate slots facing to each other for being inserted with small plate like articles.

4. The fully pulled-out type mobile apparatus according to claim 2, wherein the box body at a front side there of is provided with a partitioned slot part and a handle part.

5. The fully pulled-out type mobile apparatus according to claim 1, wherein each of the lateral sides of the extractable device has an abrupt edge respectively with a perpendicular rib to define a channel with the outer wall of the box body for each of the relay levers being able to displace along the respective channel.

* * * * *